United States Patent [19]

Kuroda

[11] 4,062,094

[45] Dec. 13, 1977

[54] APPARATUS FOR LATERALLY STRETCHING TEXTILE FABRIC AND THE LIKE

[76] Inventor: Mituru Kuroda, 16, Momoyama, Mizuno Sakon Higashimachi, Fushimi, Kyoto, Japan, 612

[21] Appl. No.: 632,981

[22] Filed: Nov. 18, 1975

[30] Foreign Application Priority Data

Dec. 27, 1974 Japan ..... 50-003409

[51] Int. Cl.[2] ..... D06C 3/06

[52] U.S. Cl. ..... 26/75; 26/97

[58] Field of Search ..... 26/75, 77, 78, 97; 226/17

[56] References Cited

U.S. PATENT DOCUMENTS

| | | | |
|---|---|---|---|
| 1,376,736 | 5/1921 | Thornber | 26/97 |
| 2,639,483 | 5/1953 | Wester | 26/75 X |
| 3,156,396 | 11/1964 | Snyder et al. | 226/17 |
| 3,414,954 | 12/1968 | Alexeff | 26/75 |
| 3,527,394 | 9/1970 | Alexeff | 226/17 |
| 3,673,647 | 7/1972 | Koster | 226/17 X |
| 3,838,481 | 10/1974 | Kuroda | 26/77 |

FOREIGN PATENT DOCUMENTS

| | | | |
|---|---|---|---|
| 45-28031 | 9/1970 | Japan | 26/97 |
| 143,347 | 5/1920 | United Kingdom | 26/97 |
| 16,879 of | 1914 | United Kingdom | 26/77 |
| 128,334 | 6/1919 | United Kingdom | 26/97 |
| 145,536 | 6/1962 | U.S.S.R. | 26/75 |

*Primary Examiner*—Robert R. Mackey

*Attorney, Agent, or Firm*—Fidelman, Wolffe & Waldron

[57] ABSTRACT

Apparatus for laterally stretching a web of textile fabric comprising a pair of web-stretching devices disposed at opposite sides of the web, each web-stretching device comprising at least a pair of parallel uncurling fingers and a control roller disposed therebetween. The fingers and the roller engage a selvage of the web to exercise a lateral pulling force thereon, and when a detector detects lateral displacement of the web, the position of the control roller relative to the fingers is changed to change the lateral pulling force on the web so as to correct the lateral displacement. At the same time the position of the detector is changed so as to prevent overshooting and render the sensitivity higher and response quicker. When the width of the web changes, the distance between the two web-stretching devices is changed so as to compensate for the change of the web width.

11 Claims, 12 Drawing Figures

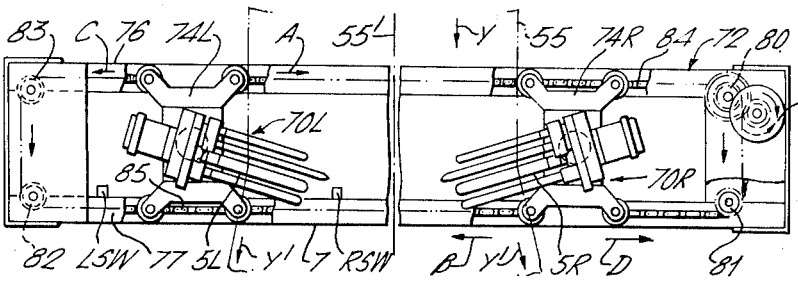
FIG. 5.
FIG. 6.
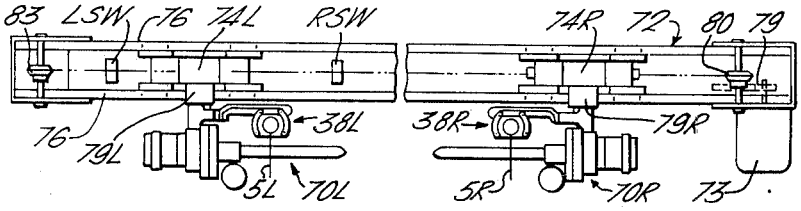
FIG. 7.
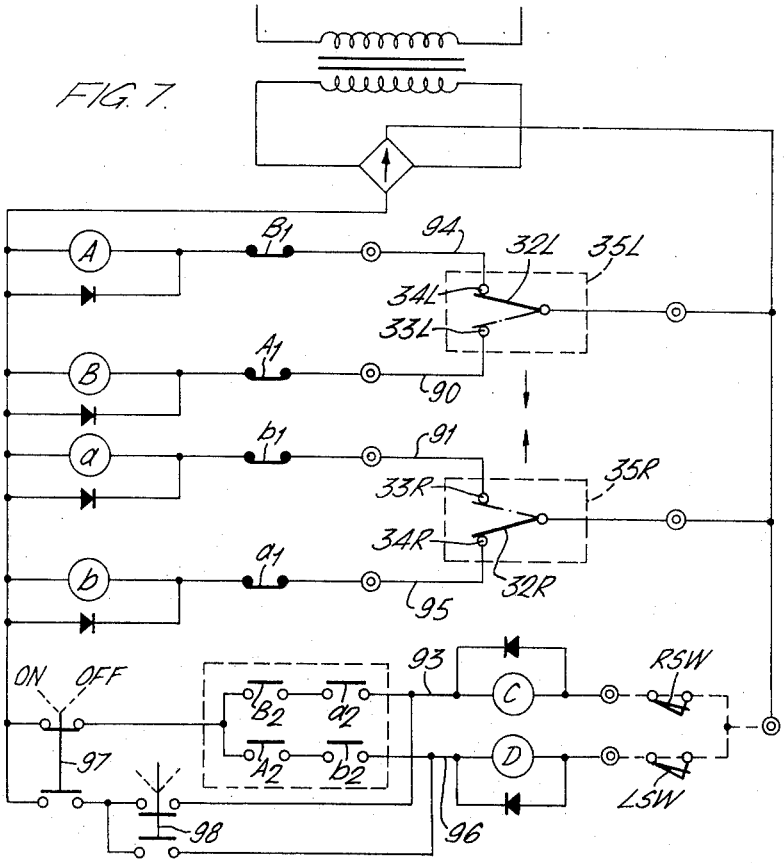
FIG. 8.
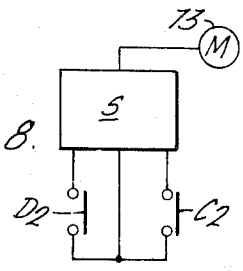

APPARATUS FOR LATERALLY STRETCHING TEXTILE FABRIC AND THE LIKE

This invention relates to an apparatus for laterally stretching a longitudinally travelling web of textile fabric or the like flexible material and more particularly to an apparatus which can correct or compensate for any lateral displacement of the web being fed or variations in the width thereof with a high degree of sensitivity and quick response to such displacement or variations.

There are known various types of web-stretching machines. One of them comprises a pair of stretching devices each having a plurality of guide rollers and/or uncurling rollers and disposed at each side of a web of cloth being fed so as to engage the edge portion or selvage thereof. The pair of stretching devices are disposed angularly relative to the feeding direction of the web so as to exercise on the web a lateral pulling force, the magnitude of which can be adjusted by changing the angular position of the rollers relative to the feeding direction of the web.

As is well known, in a web-stretching operation, abnormal changes often occur such as lateral displacement or meandering of the running web or sudden change in the width thereof, which must be instantly corrected in order to assure a proper web-stretching operation. Known types of web-stretching machines, however, have been found unsuitable for high speed operation since they cannot operate with high reliability and sufficiently quick response to such abnormal conditions in the stretching operation as mentioned above.

Accordingly, one object of the invention is to provide a novel and improved apparatus for laterally stretching a longitudinally fed web of textile fabric or the like flexible material.

Another object of the invention is to provide such a web-stretching apparatus as aforesaid which can automatically correct such abnormal conditions of the web being treated as lateral displacement or meandering of the running web and/or variations in the width thereof.

Another object of the invention is to provide such a web-stretching apparatus as aforesaid which is highly reliable in operation, sensitive in detection and quick in response.

The invention will be described in detail with reference to the accompanying drawings, wherein;

FIG. 5 is a front view of a web-stretching apparatus comprising a pair of web-stretching devices shown in FIGS. 1 through 4 mounted on a machine frame with arrangements for adjusting the distance between the two web-stretching devices;

FIG. 6 is a top plan view of the apparatus shown in FIG. 5;

FIGS. 7 and 8 are diagrams of a control circuit for the apparatus shown in FIGS. 5 and 6;

FIG. 11(*b*) is a view similar to FIG. 11(*a*) but showing the switch and the cylinder in a different operating condition.

Referring in detail to the drawings, first to FIG. 5, there are shown a pair of web-stretching devices generally designated at 70R and 70L and disposed at the opposite sides of a web 55 of cloth being fed by a suitable feeding device not shown in a vertically downward direction Y as viewed in the FIG. The two web-stretching devices are of the same construction and therefore only one of them will be described in detail. When the two web-stretching devices are commonly referred to, they will be designated by the numeral 70 without the suffix R or L.

Figure 1:
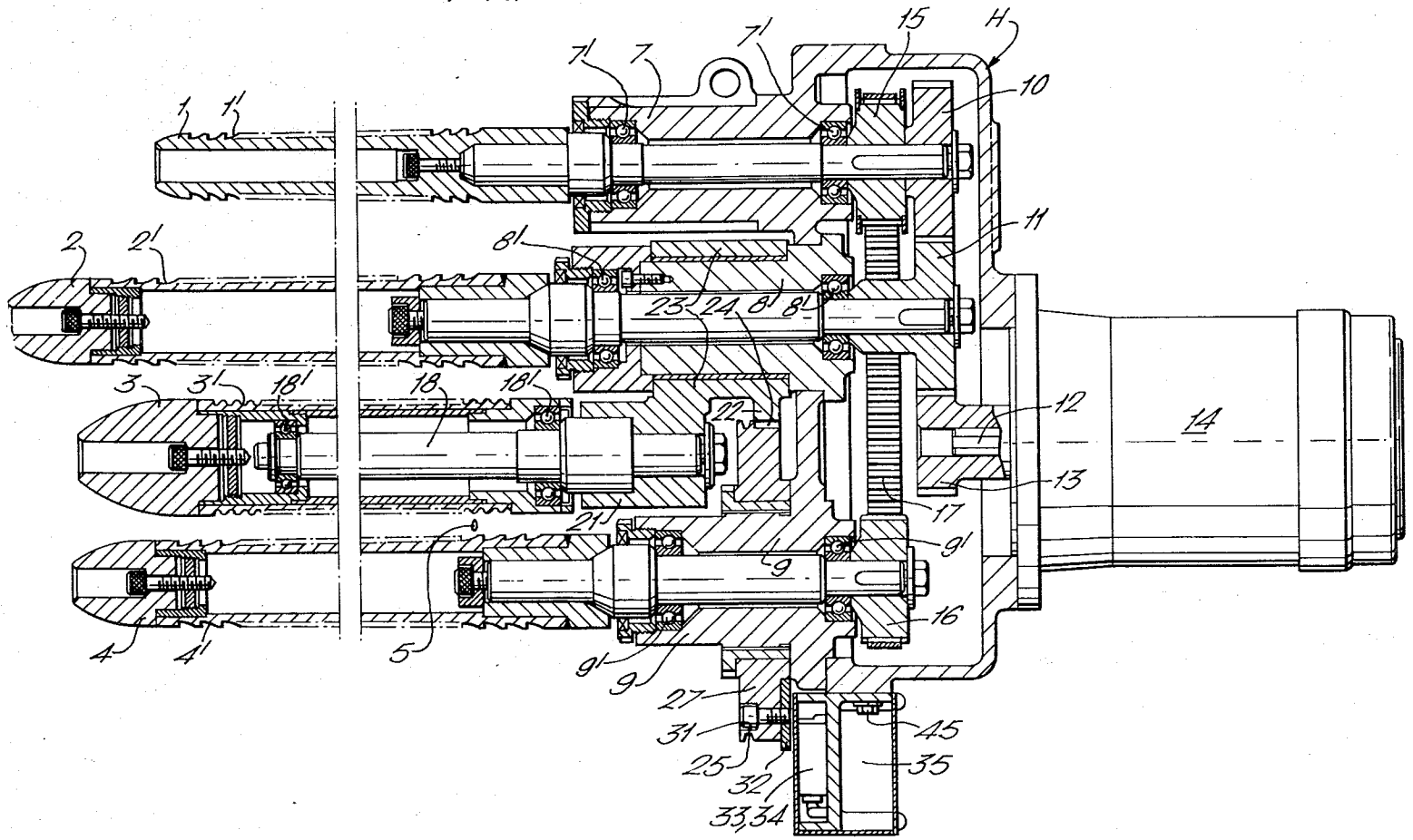
FIG. 1 is a front view in vertical section of a web-stretching device of the invention.

Each web-stretching device 70 is provided with three selvage uncurling fingers 1, 2, and 4 and a control roller 3 disposed between the fingers 2 and 4 as most clearly shown in FIG. 1. The fingers and the roller engage one side edge portion or selvage of the web meandering about the fingers and the roller like the letter S as shown in FIG. 2 to exercise a pulling force in a direction as shown by an arrow Y' so that the web is stretched or expanded laterally outwardly as it is longitudinally fed.

The two web-stretching devices are mounted on a frame 72 disposed transversely of the feeding direction Y of the web in such a manner that the distance between the two devices 70R and 70L can be adjusted as the width of the web varies. The mechanism for effecting the adjustment and an electrical control circuit therefor will be described later in detail.

Figure 2:
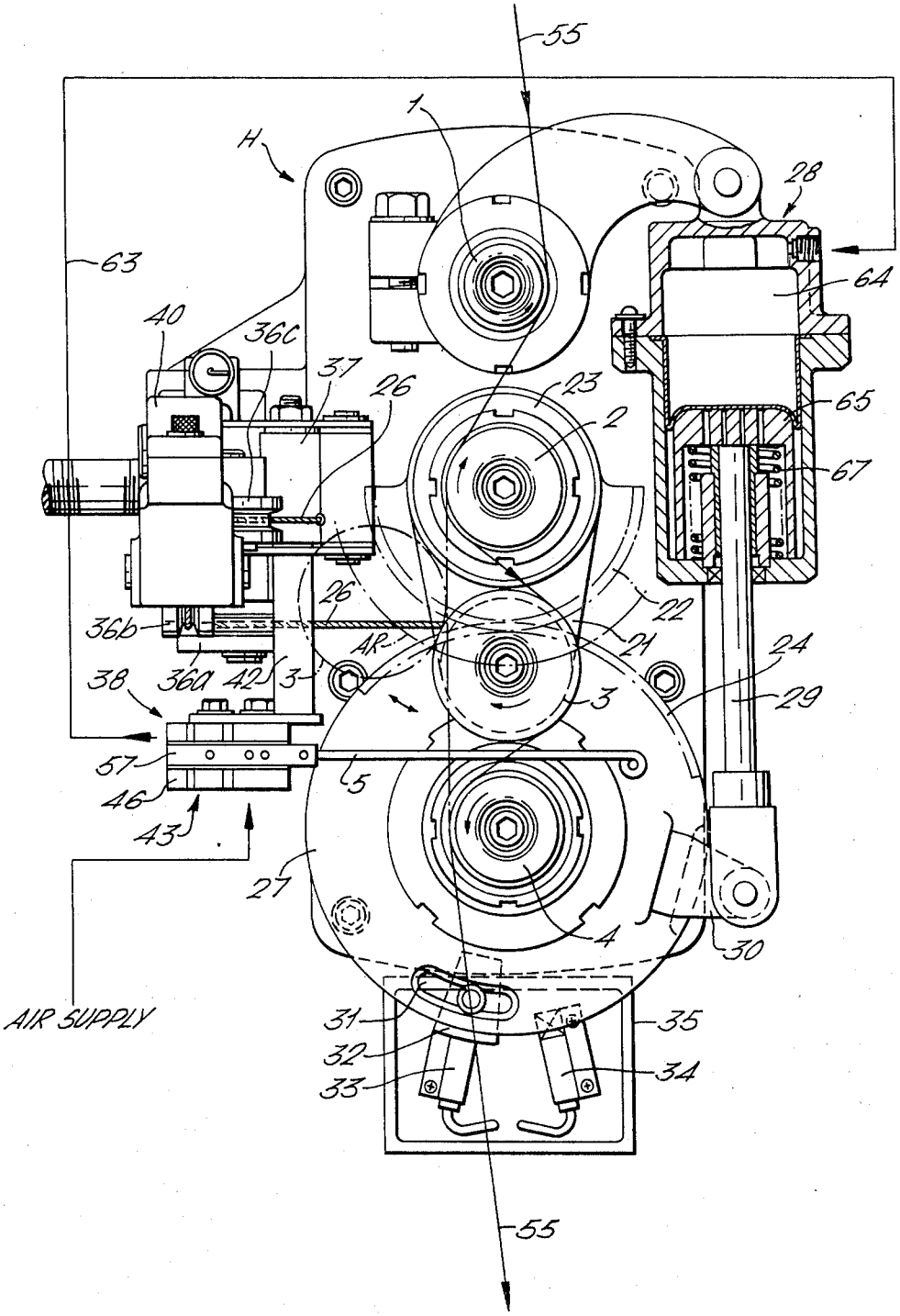
FIG. 2 is a left-hand side view partly in vertical section of the device shown in FIG. 1.

Referring now to FIGS. 1 to 4, the detailed construction of the web-stretching device 70 will be described. The device comprises a housing H formed with three bearing sleeves 7, 8 and 9 horizontally extending in parallel with each other and vertically aligned one above another as shown in FIGS. 1 and 2. The previously mentioned fingers 1, 2 and 4 have their respective inner end portions journalled in radial bearings, 7', 8' and 9', respectively, in the sleeves 7, 8 and 9. A ring 23 is mounted on the bearing sleeve 8 and has a depending holder portion 21 from which a shaft 18 projects in parallel with the axes of rotation of the rotatable fingers 1, 2 and 4. The roller 3 is journalled on the shaft 18 by means of radial bearings 18' for free rotation about the shaft 18.

The ring 23 is rotatable about the bearing sleeve 8 so that the shaft 18 with the roller 3 thereon is swingable about the bearing sleeve 8 and consequently about the finger 2, with the axes of the rotation of the finger 2 and the roller 3 being kept in parallel with each other.

To enable the swinging movement or displacement of the roller 3, the ring 23 is formed with a generally downwardly facing sector gear 22 which meshes with a corresponding sector gear 24 formed on a pulley 27 rotatably mounted on the bearing sleeve 9 for the lowest finger 4. The pulley 27 is formed with a circumferential groove 25 and a radially projecting arm 30 (FIG. 2).

An actuator or pneumatic cylinder 28 has a piston rod 29, the outer end of which is pivotally connected to the outer end of the radial projection 30 of the pulley 27. As the actuator 28 is operated in a manner to be described later, the piston rod 29 turns the pulley 27 clockwise or counterclockwise as the case may be so that through the sector gear connection 24, 22 the ring 23 is accordingly turned about the axis of the sleeve 8, that is, about the axis of rotation of the finger 2. As the ring 23 is turned, the roller 3 is swung or displaced with its axis of rotation tracing an arc AR of a circle having a center coinciding with the axis of the sleeve 8 and a radius equal to the distance between the axis of the sleeve 8 and that of the shaft 18 (FIG. 2). To put it otherwise, the roller 3 is swingable about the axis of the finger 2 between the real-line position where the axes of all three fingers 1, 2 and 4 and that of the roller 3 are vertically alligned and the dot-and-dash-line position where the roller 3 is displaced farthest from the vertical alignment.

The real-line position will be referred to as the vertically aligned position and any other position of the roller 3 laterally displaced from the vertically aligned position along the arc AR will be referred to as a displaced position. As can be easily understood, with the roller 3 in the vertically aligned position, a greater pulling force is exercised on the selvage of the running web 55 than if the roller 3 is at any other displaced position. With the roller 3 in the farthest displaced position shown by the dot-and-dash line in FIG. 2, the roller 3 applies substantially no pulling force to the selvage of the web.

By adjusting the position of the roller 3, it is possible to apply a desired amount of pulling force to either of the opposite selvages of the web so as to correct lateral displacement or meandering thereof as will be described later in detail.

Each of the fingers 1, 2 and 4 is formed on its outer circumferential surface with a helical groove 1', 2', 4' for engagement with the curled or folded selvage of the web. The roller 3 is covered with rubber or a similar material and formed with circumferential grooves 3' to provide sufficient friction between the roller and the web.

Spur gears 10 and 11 are secured to the inner ends of the fingers 1 and 2, respectively, and mesh with each other, and the gear 11 meshes with a gear 13 secured to the output shaft 12 of a motor 14, so that as the motor 14 rotates, the gears 10 and 11 and consequently the uncurling fingers 1 and 2 rotate in opposite directions.

A timing gear 15 is also secured to the inner end of the finger 1 and is connected by means of a timing belt 17 to a similar timing gear 16 secured to the inner end of the uncurling finger 4, so that the fingers 1 and 4 rotate in the same direction.

The first uncurling finger 1 is rotated in the direction (counterclockwise in FIG. 2) opposite to the feeding direction of the web (from the upper to the lower side in FIG. 2), and the second uncurling finger 2 is rotated in the direction (clockwise) opposite to the feeding direction of the web, while the lowest uncurling finger 4 is rotated in the same direction (counterclockwise) as the feeding direction of the web.

The helical grooves of the fingers 1, 2 and 3 are formed in such winding directions as to smooth out the selvage laterally outwardly as the fingers are rotated in the above-mentioned directions. The winding direction of the helical groove 1' of the finger 1 is counterclockwise in FIG. 2 since the finger is positively rotated counterclockwise; the winding direction of the helical groove 2' of the finger 2 is clockwise since the finger 2 is positively rotated clockwise; and the winding direction of the helical groove 4' of the lowest uncurling finger 4 is counterclockwise since the finger 4 is positively rotated counterclockwise.

A switch box 35 is secured to the underside of the housing H as at 45 and includes a pair of symmetrically arranged proximity switches 33 and 34 which are alternatively actuated by a piece of iron 32 attached to the lower portion of the pulley 27. The position of the piece of iron 32 on the pulley is adjustable along a slot 31 formed therein. As the pulley 27 is turned in the above-mentioned manner, either of the proximity switches is actuated by the piece of iron 32. The two proximity switches are included in a control circuit to be described later with reference to FIGS. 5 to 8.

Figure 3:
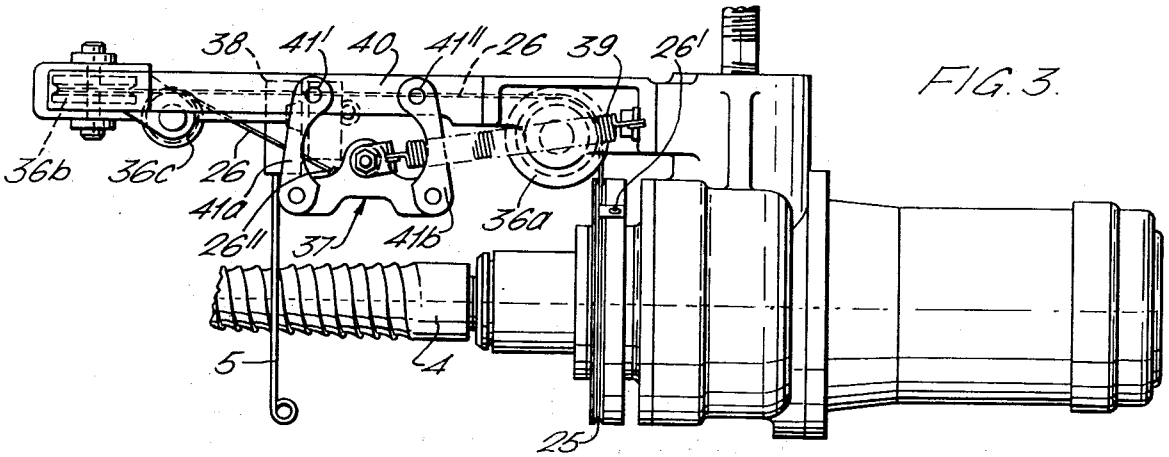
FIG. 3 is a top plan view of the detector for detecting the selvage of the web, which is employed in the web-stretching device shown in FIG. 1.
Figure 4:
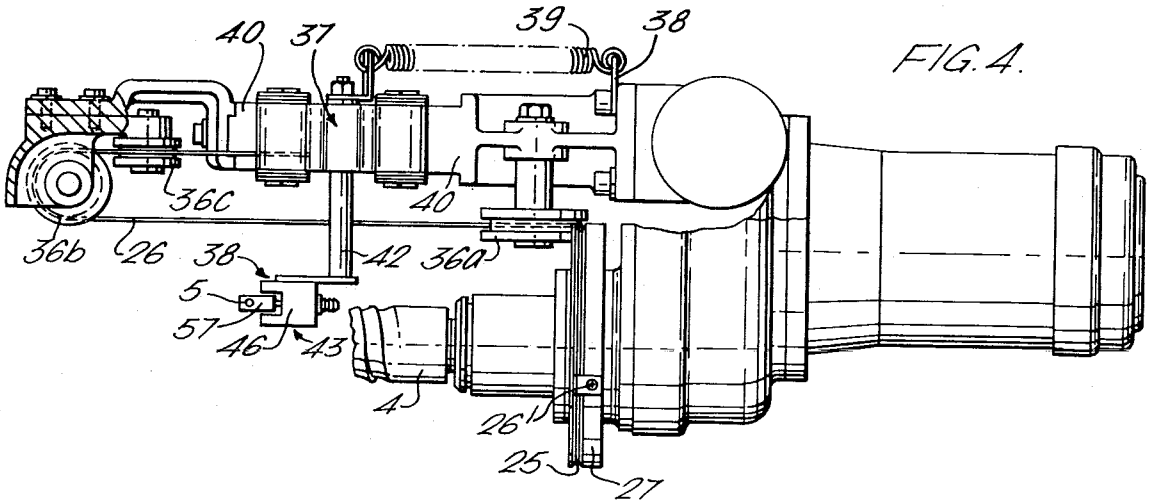
FIG. 4 is a front view of the web selvage detector shown in FIG. 3.

A rope 26 has its one end anchored as at 26' in the groove 25 of the pulley 27 and extends through the groove and passes about three guide pulleys **36*a*, 36*b* and 36*c* as far as it is fixed as at 26'' to a linkage 37 having two pairs of links (only one pair of which are shown at 41*a* and 41*b*) pivoted as at 41' and 41'' to an arm 40 extending from the housing H generally in parallel with the fingers (FIGS. 3 and 4). A spring 39 biases the linkage 37 toward the right in FIG. 3 so as to tension the rope 26**.

When the pulley 27 is turned clockwise in FIG. 2 by the piston rod 29 in the manner to be described later in detail, the rope 26 is pulled leftward in FIG. 3 thereby to cause the linkage 37 to swing leftward against the force of the spring 39. On the contrary, when the pulley 27 is turned in the opposite direction (counterclockwise), the pull on the rope 26 is released so that the linkage 37 is pulled back toward the right in FIG. 3 by the force of the spring 39.

A vertical rod 42 depends from the linkage 37 and a selvage detector 38 is secured to the lower end of the rod 42. The selvage detector comprises a pneumatic switch 43 and a selvage feeler 5 in the form of a rod or bar.

Figure 9:
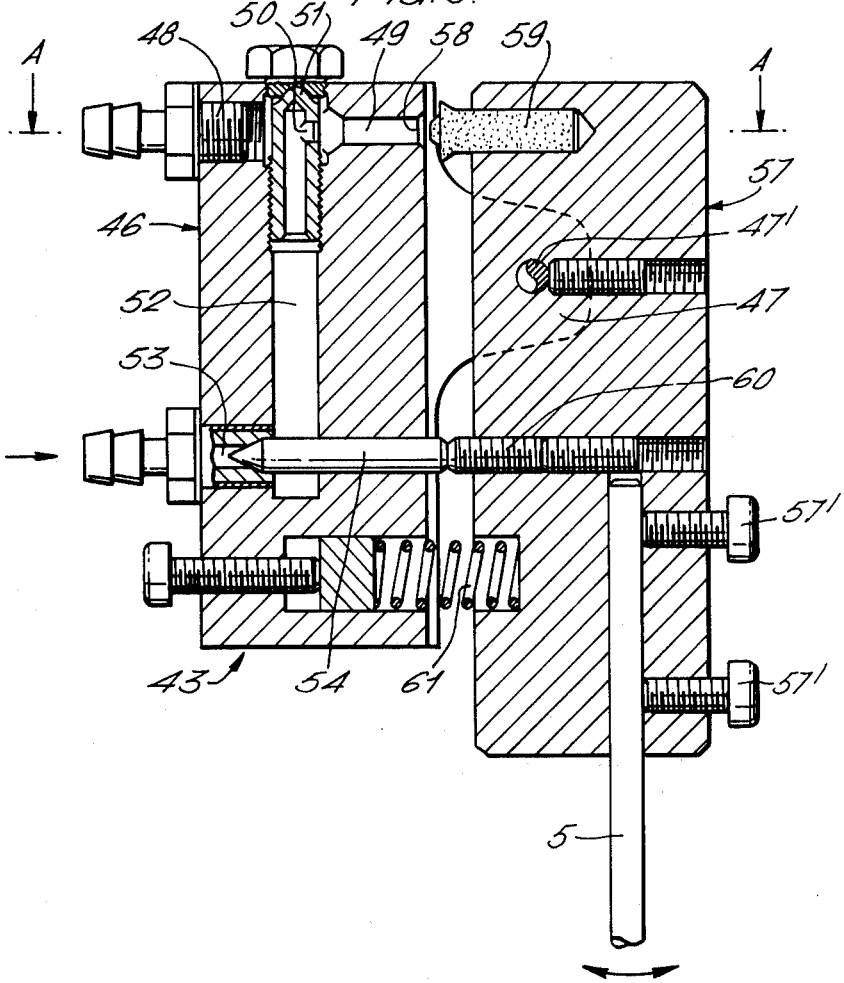
FIG. 9 is a top plan view in transverse section of a pneumatic switch used in the web selvage detector shown in FIGS. 3 and 4.
Figure 10:
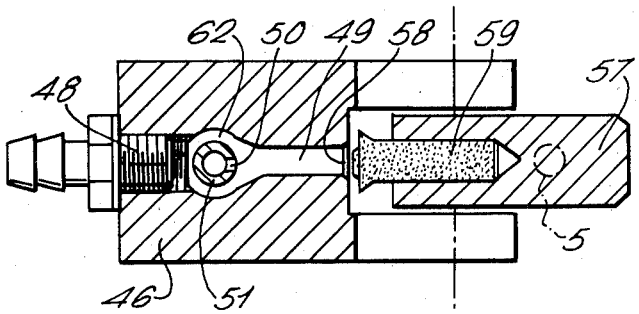
FIG. 10 is a vertical section taken along line A-A in FIG. 9.

As shown in detail in FIGS. 9 and 10, the switch 43 comprises a stationary block 46 and a movable block 57 pivoted as at 47' to a lateral ear 47 of the stationary block. The feeler bar 5 is secured to the movable block 57 by a pair of screws 57'. The stationary block 46 is fixed to the lower end of the vertical rod 42 so that the feeler bar extends between the roller 3 and the lowest finger 4 horizontally and perpendicularly to the axes of rotation thereof as best shown in FIG. 2.

Turning momentarily to FIGS. 5 and 6, the web 55 to be treated has its opposite selvages engaged by the fingers and roller of the right-hand and left-hand web-stretching devices 70R and 70L, with their respective feeler bars 5R and 5L touching the opposite edges of the web. If the web meanders or is displaced laterally in either direction, the feeler bars 5R and 5L detects the displacement and the detectors 38R and 38L cause the web-stretching devices to operate in opposite manners to each other to correct the displacement.

Turning back to FIGS. 9 and 10, the stationary block 46 of the pneumatic switch 43 has an inlet passage 53 which communicates with one end of a passage 52, the other end of which in turn communicates with an outlet passage 48 and an exhaust passage 49 through an ejector pipe 51 having a jet opening 50 turned toward the exhaust passage 49. A source of pressurized air (not shown) is connected to the inlet passage 53, and the outlet passage 48 is connected through a conduit schematically shown as a mere line 63 to the actuator 28 (FIGS. 11(*a*) and 11(*b*)).

A stop valve 54 is provided to open or close the inlet passage 53. The movable block 57 is provided with a projection or screwed plug 60 to act on the valve 54 to close the passage 53, and a valve 59 to open or close the exhaust passage 49, as will be described in detail presently.

A spring 61 urges the movable block 57 toward the right (or counterclockwise about the pin 47') in FIG. 9 to a position at which the valve 54 opens the inlet passage 53 and the valve 59 closes the exhaust passage 49. If the feeler bar 5 is moved by the selvage of the web toward the left (or clockwise about the pin 47') in FIG. 9 against the force of the spring 61, the valve 59 opens the passage 49.

Figure 11A:
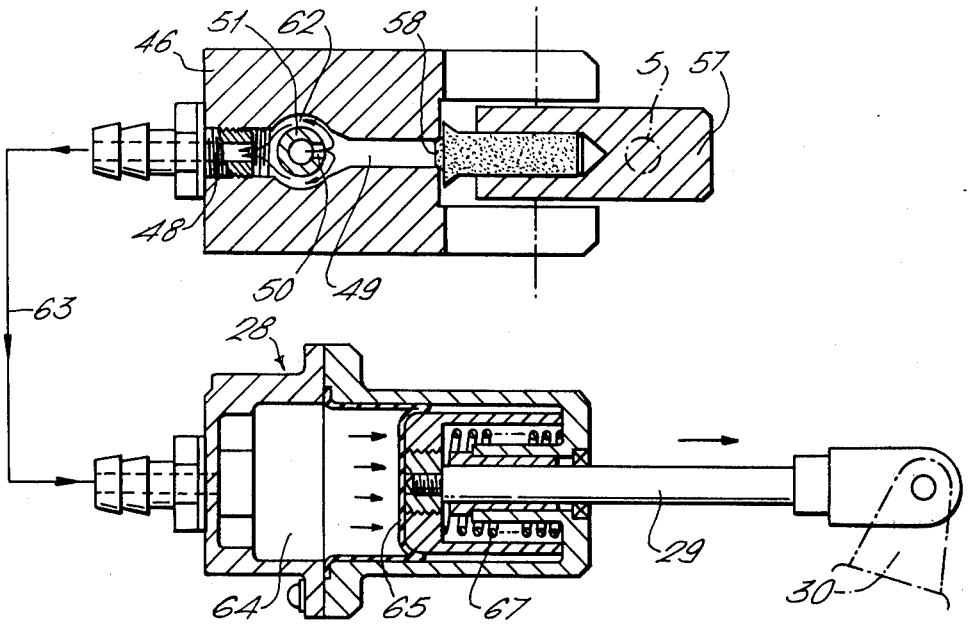
FIG. 11(*a*) is a sectional view of the switch shown in FIGS. 9 and 10 with a cylinder to be controlled by the switch.
Figure 11B:
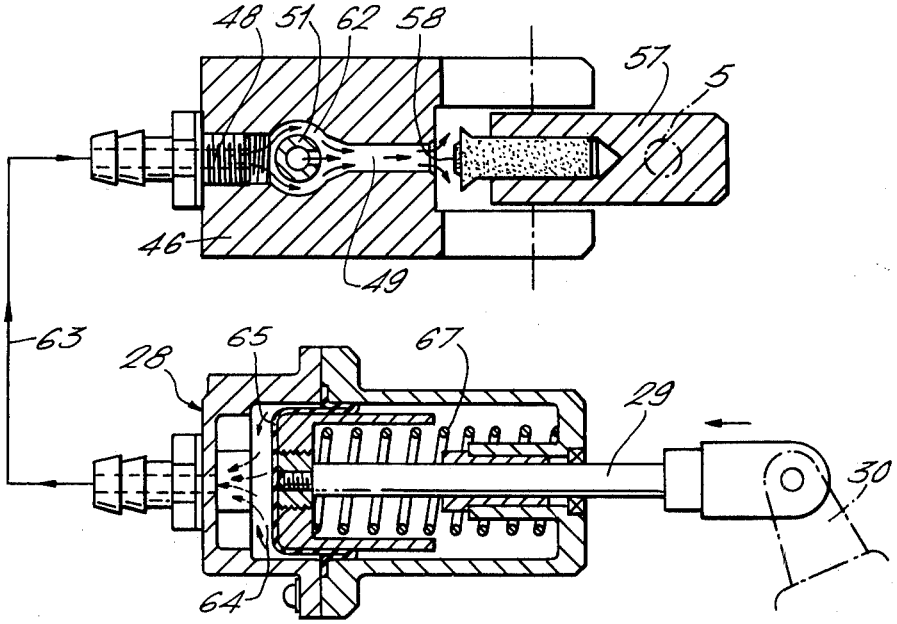

With reference to FIGS. 5 and 6 as well as FIGS. 9 to 11, suppose that in FIG. 5 the web has happened to be displaced to the right. In the left-hand web-stretching device 70L, the selvage of the web that is engaged by the fingers 1, 2 and 4 and the control roller 3 moves away from the feeler bar 5L (that is, toward the right in FIGS. 6 or 9), whereupon the spring 61 causes the block 57 to turn counterclockwise about the pivot pin 47' so that the feeler bar follows the receding selvage as far as the valve 59 closes the passage 49. With the projection 60 having been separated from the stop valve 54, pressurized air pushes the valve 54 out of the way and flows through the passage 52 to jet through the opening 50 out into the passage 49. With the valve 59 closing the passage 49, however, the air passes through a space 62 about the ejector pipe 51 and through the outlet passage 48 and then the conduit 63 into the actuator 28 (FIGS. 2 and 11).

The actuator 28 comprises a cylinder 64 and a diaphragm piston 65 urged by a spring 67 leftward in FIG. 11. The previously mentioned piston rod 29 the outer end of which is connected to the radial projection 30 of the pulley 27 has its inner end connected to the piston 65.

The pressurized air that has entered into the cylinder chamber 64 pushes the piston 65 toward the right in FIG. 11(*a*) against the force of the spring 67 so that the piston rod 29 is moved to the right in FIG. 11(*a*) or downward in FIG. 2.

As previously mentioned, when the piston rod 29 is pushed downward in FIG. 2, the roller 3 is moved toward the real-line position in FIG. 2, thereby increasing the pulling force on the selvage of the web which the roller contacts so that the selvage is pulled back toward the left in FIGS. 5 and 9.

When the web is displaced toward the left so that the feeler bar 5 is moved toward the left by the web selvage, the movable block 57 is turned clockwise about the pin 47' against the force of the spring 61, whereupon the valve 59 opens the passage 49, so that pressurized air passes through the passages 53 and 52 to be jetted through the opening 50 and thence through the passage 49 out into the open air. The jet stream withdraws the air in the cylinder chamber 64 through the passages 63 and 48 and the space 62 to be exhausted out into the atmosphere. This helps the spring 67 to move the piston 64 with the piston rod 29 toward the left in FIG. 11(*b*) more quickly than otherwise, whereupon the pulley 27 is turned counterclockwise in FIG. 2 so that the roller 3 is displaced clockwise toward the dot-and-dash-line position in FIG. 2 thereby reducing the pulling force exercised on the selvage of the web. This prevents farther displacement of the web toward the left in FIG. 9.

When the valve 59 is separated farther than a predetermined distance from the end 58 of the exhaust passage 49, the valve 54 closes the passage 53 thereby to prevent useless consumption of pressurized air.

While the left-hand web-stretching device operates in the above manner, the right-hand web-stretching device operates simultaneously but in the opposite manner so as to help the operation of the left-hand device, as will be easily understood from the above explanation. In other words, the two web-stretching devices cooperate in opposite manners to help the operation of each other. For example, if the web is displaced rightward and the left-hand web-stretching device 70L operates to pull the web back toward the left in the above-mentioned manner, the right-hand web-stretching device 70R simultaneously operates to reduce the tension on the opposite selvage of the web so as to help the device 70L pull the web back toward the left, and vice versa.

The above operation of detecting lateral displacement of the web and succeding correction of the displacement conducted in cooperation by the two web-stretching devices help prevent meandering of the web and keep it running substantially straight.

When the piston rod 29 is moved downward as mentioned above to move the pulley 27 clockwise in FIG. 2, the roller 3 is displaced toward the real-line position and at the same time the pulley 27 pulls the rope 26 so that the linkage 37 swings to the left in FIGS. 3 and 4 against the force of the spring 39 thereby to move the whole of the selvage detector 38 in the same direction.

On the contrary, when the piston rod 29 is moved upward, the pulley 27 is rotated counterclockwise to move the roller 3 toward the dot-and-dash-line position and at the same time release the pull on the rope 26 so that the spring 39 urges the linkage 37 to swing back thereby to move the whole of the selvage detector 38 toward the original position.

This movement of the selvage detector itself following the lateral displacement of the web helps not only prevent overshooting but also render the sensitivity of the detector and the accuracy and precision of the subsequent correction of the displacement of the web higher than if the position of the detector were fixed or stationary.

The above explanation has been based on the assumption that the width of the web remains substantially the same. If the width changes so much that the two web-stretching devices spaced a fixed distance appart from each other cannot accommodate the change, the distance between the two devices must be changed in accordance with the change of the web width.

Turning again to FIGS. 5 and 6, the machine frame 72 is disposed transversely of the web 55 being fed and the two web-stretching devices 70R and 70L are mounted on the frame 72 symmetrically with respect to the central line 55' of the web 55. Each web-stretching device 70 is carried through a known angle setting mechanism 79R, 79L on a carriage 74R, 74L which roll on vertically spaced pairs of horizontally extending rails 76, 77. The angle setting mechanism is so arranged as to be able to set the fingers so that their axes make a desired angle in the feeding direction Y of the web with the direction perpendicular to the direction Y. The mechanism can be of any known type and per se constitutes no part of the invention so that no detailed explanation thereof will be given.

Four sprocket wheels 80, 81, 82 and 83 are provided in the four corners of the frame 72. A chain 84 has its one end secured to one of the upper legs of the carriage 74L and passes the upper legs of the carriage 74R and about the sprocket wheels 80 and 81 and has its opposite end secured to one of the lower legs of the carriage 74R. Another chain 85 has its one end secured to the other of the upper legs of the carriage 74L and passes about the sprocket wheels 83 and 82 and then past the lower legs of the carriage 74L and has its opposite end secured to the other of the lower legs of the carriage 74R.

The sprocket wheel 80 is rotated in either direction by a motor 73 through a reduction gearing 79. It will be easily seen that when the sprocket wheel 80 is rotated clockwise in FIG. 5, the chains 84 and 85 are moved in the directions A and B, respectively, so that the two web-stretching devices 70R and 70L are moved toward each other. If the sprocket wheel 80 is rotated counterclockwise in FIG. 5, the chains 84 and 85 are moved in the directions D and C, respectively, so that the two devices 70R and 70L are moved away from each other. This control is performed by the circuit shown in FIGS. 7 and 8 connected between the motor 73 and the previously mentioned proximity switches 33R, 34R and 33L, 34L provided on the two web-stretching devices 70R and 70L.

Suppose that the width of the web has appreciably decreased. The feeler bars 5R and 5L of both web-stretching devices 70R and 70L at the right-hand and left-hand sides move toward each other so that the pulleys 27R and 27L are turned in such a direction (clockwise in FIG. 2) that the pieces of iron 32R and 32L cause the proximity switches 33R and 33L to be closed. The proximity switches 33 and 34 of each of the two web-stretching devices in FIG. 2 are schematically shown merely as stationary contacts and the piece of iron 32 as a movable contact in the circuit of FIG. 7 for convenience and simplicity of illustration.

Upon closure of the switches 33R and 33L, relays *a* and B are energized via lines 91 and 90 through normally closed contacts *b*1 and A1, respectively. When energized, the relays *a* and B open normally closed contacts *a*1 and Bl and at the same time close normally open contacts *a*2 and B2 so that a relay C is energized via a line 93, with an automatic-manual change-over switch 97 being closed in the line 93. The enrgization of the relay C causes a contact C2 to be closed, whereupon the motor 73 is rotated through a control panel S so that the sprocket wheel 80 is rotated clockwise in FIG. 5 to cause the two web-stretching devices 70R and 70L to approach each other.

If the width of the web has appreciably increased, the feeler bars 5R and 5L are moved away from each other so that the pulleys 27R and 27L of the two web-stretching devices are turned in such a direction (counterclockwise in FIG. 2) that the iron pieces 32R and 32L cause the other proximity switches 34R and 34L to be closed.

Upon closure of the switches 34R and 34L, relays *b* and A are energized via lines 95 and 94 through normally closed contacts *a*1 and B1, respectively. When energized, the relays *b* and A open normally closed contacts *b*1 and A1 and at the same time close normally open contacts *b*2 and A2, so that a realy D is energized via a line 96 with the switch 97 being closed in the line 96. The energization of the relay D causes a contact D2 to be closed, whereupon the motor 73 is rotated so that the sprocket wheel 80 is rotated counterclockwise in FIG. 5 thereby to cause the two web-stretching devices to move away from each other.

When the switch 97 is closed to the other side, the circuit is ready for manual operation. As can be easily understood, by operating a switch 98 it is possible to selectively energize either of the relays C and D, thereby to rotate the sprocket wheel 80 clockwise or counterclockwise.

A pair of limit switches RSW and LSW are provided on the frame 72 so as to limit the range within which the web-stretching devices are displaced along the frame thereby preventing inadvertent damage to the web-stretching devices or any other part of the machine.

What I claim is:

1. A device for laterally stretching a web of textile fabric or the like flexible material, comprising a pair of web-stretching devices engaging opposite side portions of said web, each of said pair of web-stretching devices including at least a pair of parallel uncurling fingers rotatable about their respective axes; a control roller rotatable about its own axis and arranged in parallel with and generally between said fingers; said fingers and roller being adapted to engage a side portion of said web being longitudinally fed so that a lateral pulling force is exercised on said web side portion; means for detecting lateral displacement of said web relative to the feeding direction thereof; first position changing means operable in response to said detecting means for changing the position of said roller relative to said fingers by displacing the axis of rotation of said roller about the axis of rotation of one of said fingers, while substantially keeping the parallel relation of said axes of rotation, thereby changing the magnitude of said lateral pulling force exercised on said web side portion; and second position changing means for changing the position of said detecting means in accordance with lateral displacement of said web.

2. The device of claim 1, further including means for synchronizing the operations of said first and said second position changing means, said synchronizing means including an actuator mechanism for displacing said means for detecting lateral displacement of said web simultaneously with the position change of said roller, whereby a high level of detection sensitivity is maintained.

3. The device of claim 2, wherein said detecting means comprises: a feeler bar extending generally transversely of said axes of rotation so as to be engaged by the selvage of said web for simultaneous movement with lateral displacement of said web; and control means operated by said feeler bar to control the operation of said first position changing means.

4. The device of claim 3, wherein said second position changing means includes means for supporting said detecting means so as to be displaceable axially of said fingers.

5. The device of claim 4, wherein said first position changing means includes a pneumatically operated cylinder having a piston rod operatively connected to said second position changing means, and wherein said control means includes a pneumatic switch for controlling the operation of said cylinder.

6. The device of claim 5, further including second switch means, the operation of which is controlled by said first position changing means so that said switch means takes a first operative position in response to a first operative condition of said first position changing means and alternatively a second operative position in response to a second operative condition of said first position changing means.

7. The device of claim 5, wherein said pneumatic switch comprises: a first member secured to said supporting means and a second member having said feeler bar secured thereto and being pivotally connected to said first member; said first member having an inlet passage connectable to a source of pressurized air, an exhaust passage open to the atmosphere, an outlet passage connected to said pneumatic cylinder, and an ejector having one end communicating with said inlet passage and a jet outlet communicating with both said exhaust and outlet passages; and said second member having first valve means for selectively opening and closing said exhaust passage.

8. The device of claim 7, wherein said second member has second valve means for selectively opening and closing said inlet passage.

9. A device for laterally stretching a web of textile fabric or the like flexible material, comprising a pair of web-stretching devices engaging opposite side portions of said web, each of said pair of web-stretching devices including a first, a second and a third uncurling finger having a helical groove formed on the outer circumferential surface thereof; means for supporting said fingers in parallel with each other and rotatably about their respective axes; means for positively rotating at least one of said fingers; means for mechanically connecting said fingers for simultaneous rotation; a control roller rotatable about its own axis; means for supporting said control roller generally between said second and third fingers and in parallel therewith; said fingers and roller being so arranged as to engage a selvage of said web being longitudinally fed so that a lateral pulling force is exercised on said web selvage; means for detecting lateral displacement of said web relative to the feeding direction thereof; first position changing means operable in response to said displacement detecting means to change the position of said control roller relative to said fingers by displacing the axis of rotation of said control roller about the axis of rotation of said second finger, while keeping the parallel relation between said axes of rotation, thereby changing the magnitude of said lateral pulling force; second position changing means for changing the position of said displacement detecting means; and means for synchronizing the operations of said two position changing means said synchronizing means including an actuator mechanism for displacing said means for detecting lateral displacement of said web simultaneously with the position change of said roller.

10. A device for laterally stretching a web of textile fabric or the like flexible material, comprising a pair of web-stretching devices engaging opposite side portions of said web, each of said pair of web-stretching devices including at least a pair of parallel uncurling fingers rotatable about their respective axes; a control roller rotatable about its own axis and arranged in parallel with and generally between said fingers; said fingers and roller being adapted to engage a side portion of said web being longitudinally fed so that a lateral pulling force is exercised on said web side portion; means for detecting lateral displacement of said web relative to the feeding direction thereof and first position changing means operable in response to said detecting means for changing the position of said roller relative to said fingers by displacing the axis of rotation of said roller about the axis of rotation of one of said fingers, while substantially keeping the parallel relation of said axes of rotation, thereby changing the magnitude of said lateral pulling force exercised on said web side portion; means to change the distance between said pair of webstretching devices and second position changing means for changing the position of said detecting means in accordance with lateral displacement of said web.

11. A device for laterally stretching a web of textile fabric or the like flexible material, comprising a pair of web-stretching devices engaging opposite side portions of said web, each of said pair of web-stretching devices including a first. a second and a third uncurling finger having a helical groove formed on the outer circumferential surface thereof; means for supporting said fingers in parallel with each other and rotatably about their respective axes; means for positively rotating at least one of said fingers; means for mechanically connecting said fingers for simultaneous rotation; a control roller rotatable about its own axis; means for supporting said control roller generally between said second and third fingers and in parallel therewith; said fingers and roller being so arranged as to engage a selvage of said web longitudinally fed so that a lateral pulling force is exercised on said web selvage; means for detecting lateral displacement of said web relative to the feeding direction thereof; first position changing means operable in response to said displacement detecting means to change the position of said control roller relative to said fingers by displacing the axis of rotation of said control roller about the axis of rotation of said second finger, while keeping the parallel relation between said axes of rotation, thereby changing the magnitude of said lateral pulling force; means for supporting said pair of web-stretching devices in a laterally spaced apart relation to each other so that said web has each of its selvages engaged by said uncurling fingers and control roller of one of said pair of web-stretching devices; and translation means operable in response to said displacement detecting means to change the distance between said pair of web-stretching devices when web width changes and second position changing means for changing the position of said detecting means in accordance with lateral displacement of said web.

* * * * *